United States Patent [19]

Yamada et al.

[11] Patent Number: 4,784,287

[45] Date of Patent: Nov. 15, 1988

[54] BULKHEAD DEVICE FOR USE IN CONTAINER LINER BAGS

[75] Inventors: Hideo Yamada; Shigemi Ichiki; Hisamoto Naniwa; Susumu Uchida; Kenji Kadokura; Susumu Tsunoda; Kunio Nakajima, all of Tpkyo, Japan

[73] Assignees: Nippon Yusen Kaisha; Nihon Matai Co., Ltd., both of Tokyo, Japan

[21] Appl. No.: 879,433

[22] Filed: Jun. 27, 1986

[30] Foreign Application Priority Data

Jun. 29, 1985 [JP] Japan ..... 60-99275

[51] Int. Cl.[4] ..... B65D 25/16

[52] U.S. Cl. ..... 220/403; 220/1.5; 383/41; 383/119

[58] Field of Search ..... 220/403, 1.5, 22, 22.1, 220/22.3; 383/17, 38, 119, 100, 103, 41

[56] References Cited

U.S. PATENT DOCUMENTS

| | | | |
|---|---|---|---|
| Re. 29,721 | 8/1978 | Ukmar et al. | 220/403 X |
| 1,581,689 | 4/1926 | Perin | 220/1.5 X |
| 3,145,834 | 8/1964 | Hillger et al. | 220/1.5 X |
| 3,951,284 | 4/1976 | Fell et al. | 383/41 X |
| 3,980,196 | 9/1976 | Paulyson et al. | 220/1.5 |
| 4,054,226 | 10/1977 | Bjelland et al. | 220/1.5 X |
| 4,461,402 | 7/1984 | Fell | 383/119 X |

*Primary Examiner*—Steven M. Pollard

*Attorney, Agent, or Firm*—Cushman, Darby & Cushman

[57] ABSTRACT

A bulkhead for use in container liner bags comprises a liner bag mounted to the inside of a container and containing goods charged therein, a plurality of support members disposed while being vertically spaced apart from each other to the end of the container on the side of the door, the both ends of which are detachably fitted to engage into the recessed grooves on both of the side walls of the container for supporting the end face of the liner bag on the side of the door, a positioning apparatus for fixing the vertical position of the uppermost support member and a spacer apparatus for suspending the support members other than the uppermost support member from the just-mentioned uppermost support member for fixing the vertical position between them. The assembly of the support members can serve as an effective bulkhead because of easy attaching and detaching while possessing sufficient withstanding force.

6 Claims, 5 Drawing Sheets

BULKHEAD DEVICE FOR USE IN CONTAINER LINER BAGS

BACKGROUND OF THE INVENTION

1. Field of the Invention

This invention concerns a container liner bag used for transporting granular goods or bulks such as malts, grains, feed stocks and sands, or malodorous goods such as hides. More specifically, the present invention relates to a bulkhead device for supporting the end face of a container liner bag on the side of a door.

2. Description of the Prior Art

Granular goods such as malts, grains, feed stocks and sands are generally transported on bulk containers which, for example, have three manholes of about 50 cm diameter formed at the ceiling. It has also been attempted to transport such goods by using dry containers.

When transportating granular goods on containers, it is necessary to wash the inside of the container after every transportation so that goods formerly transported have no undesired effects on the goods to be transported subsequently.

However, the washing work is not always easy even in a bulk container which can be washed relatively easily and the container can not be used again till the inside thereof is completely dried after the washing. Particularly, the dry containers involve a problem upon transporting food goods from a sanitary point of view since the washing procedures are relatively complex and various kinds of goods are handled in the dry containers.

In addition, while smelly hides are usually transported on dry containers, keenly smelling water droplets are deposited to the inner walls, particularly, to the bottom walls of the containers and can not completely be deodorized by usual washing. Further, since the droplets contain salts, they cause the problem of corrosion in the containers.

For overcoming the foregoing problems, it has heretofore been proposed, for example, as disclosed in U.S. Pat. No. 3,951,284 (Canadian Pat. No. 948039) and U.S. Pat. No. 4,461,402 (Canadian Pat. No. 1179613), that an inner liner or liner bag be installed at the inside of a container and that a plurality of tabs disposed spaced apart from each other along the upper circumferential edge of the inner liner be engaged to hooks disposed at the periphery of the container directly or by way of stretcheable connectors, so that the inner liner is secured to the inside of the container.

By using these container inner liners, the need for washing the inside of the container and subsequent drying work is eliminated since only the inner liner needs to be replaced. In addition, if it is applied to a dry container, the dry container can be utilized as a bulk container thereby enabling significant improvements in the transportation efficiency, etc.

In the case of using such an inner liner or liner bag, since a large force is exerted from the goods or cargoes to the end face of the liner bag on the side of a door, it needs a bulkhead, that is, a retainer panel capable of sufficiently resisting the force even if the door is opened.

Furthermore, since not all of the dry containers or bulk containers are adapted to be installed with the liner bag, it is demanded that the bulkhead can be mounted without reconstructing the existent containers and that the bulkhead can be reduced in the size as much as possible when it is not used.

The U.S. Pat. No. 3,951,284 (Canadian Pat. No. 948039) proposes the bulkhead device of this kind, in which a bulkhead made of plywood or the like in combination with cross beams and vertical ties is fitted to engage into recessed grooves formed on both of the sides of the container on the side of a door, or disposed at the back of the corner posts disposed to both of the sides of the container on the side of a door.

However, since a bulkhead device of this kind has a predetermined rigid configuration, if it is fitted to engage under tilting into the recessed grooves disposed to both sides of the container on the side of the door, it is difficult to engage the same into the recessed grooves since the orthogonal ends thereof abut against the bottom of the recessed grooves. This problem may be overcome by reducing the lateral size of the bulkhead, but this increases the lateral rattling when the bulkhead is fitted to engage into the recessed grooves and it may even possibly be detached from the recessed grooves thereby causing an extreme danger. It has another defect that it can not be reduced in the size when it is not used.

Further, the bulkhead device as described above, is made of a rigid plate and an opening of a predetermined shape is formed therein, through which the goods in the container inner liner are discharged. However, such a structure can not cope with a case where a large opening may be required depending on the kind of goods.

It may be considered to upwardly slide the bulkhead along the recessed groove as a countermeasure. However, since the bulkhead undergoes an intense force from the inside in a state where goods are charged in the container inner liner, it is actually almost impossible to slide the bulkhead upwardly along the recessed grooves.

SUMMARY OF THE INVENTION

Accordingly, it is an object of this invention to provide a bulkhead device for use with container liner bags capable of sufficiently resisting the force from the goods charged in the liner bag, being capable of attaching and detaching easily and reducing in the size when it is not used.

It is another object of this invention to provide a bulkhead device for use with container liner bags capable of optionally setting the size of the opening disposed to the liner bag upon discharging the goods from the inside of the liner bag.

The foregoing objects can be attained in accordance with this invention in a bulkhead device for use in container liner bags comprising:

- a liner bag installed to the inside of a container and containing goods charged therein;
- a plurality of support members disposed spaced apart vertically from each other to the end of the container on the side of a door and detachably fitted to engage at the both ends thereof into the recessed grooves of both of the side walls of the container for supporting the end face of the liner bag on the side of the door;
- positioning structure for fixing the vertical position of the uppermost supporting member and
- spacer structure suspending the support members other than the uppermost support member from the just mentioned uppermost support member thereby fixing the vertical position between the members.

Since both ends of the respective support members are fitted to engage into the recessed grooves to both of the side walls of the container, they can sufficiently withstand the load from the goods.

Further, since the respective support members are suspended from the uppermost support member by means of the spacer structure, a certain degree of freedom can be obtained between each of the support members and between the support member and the spacer structure. Accordingly, when each of the support members is attached or detached under tilting to and from the recessed groove of the container, the operation is very much facilitated. Furthermore, these support members can be gathered compact when it is not used.

In addition, since the respective support members are fixed to vertical positions and take a predetermined shape, by means of the positioning structure and the spacer structure when they are mounted as the bulkhead to the container, they are quite free from the disadvantage caused by the absence of rigid joining between each of the support members.

BRIEF DESCRIPTION OF THE ACCOMPANYING DRAWINGS

These and other objects, as well as features of this invention will be made clearer by reading the following descriptions regarding the preferred embodiments according to this invention while referring to the appended drawings, wherein FIG. 1 is a plan view illustrating the state of the bulkhead device according to this invention mounted to a container;

DESCRIPTION OF PREFERRED EMBODIMENTS

Preferred embodiments according to this invention will now be described specifically referring to the examples.

Figure 1:
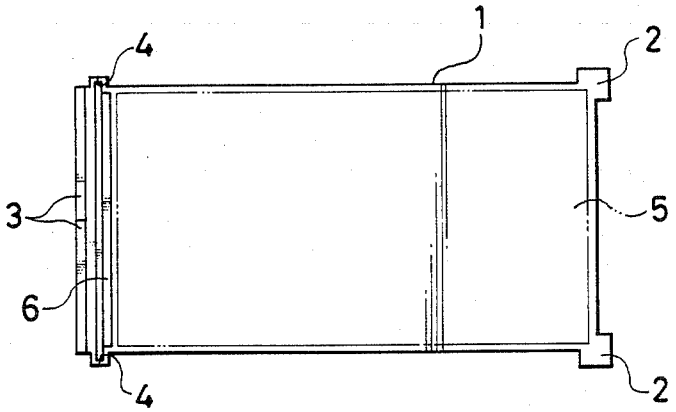

In FIG. 1, a dry container 1 has square grooves 2 at the corners on the front side and recessed grooves 4 at the corners on the side of doors 3, in which a liner bag 5 is detachably installed to the inside of the container 1. The end face of the liner bag 5 on the side of the doors 3 is supported by a bulkhead device or retainer plate assembly 6 detachably disposed to the recessed grooves 4.

Figure 2:
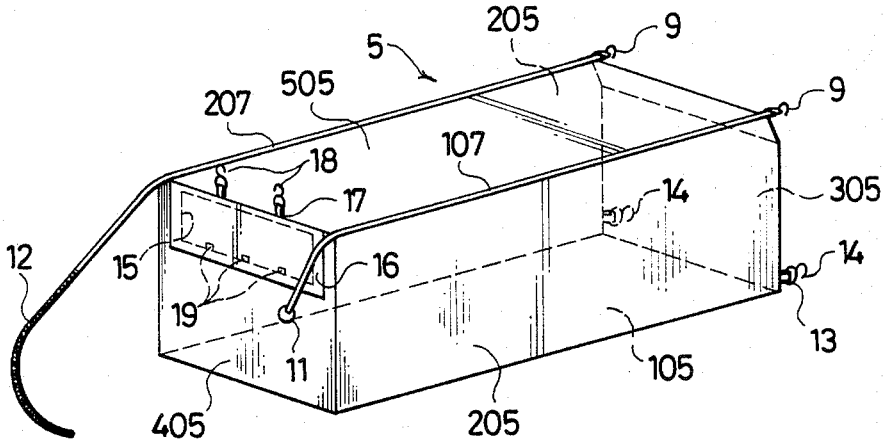
FIG. 2 is a perspective view of a container liner bag mounted to the inside of the container.
Figure 9:
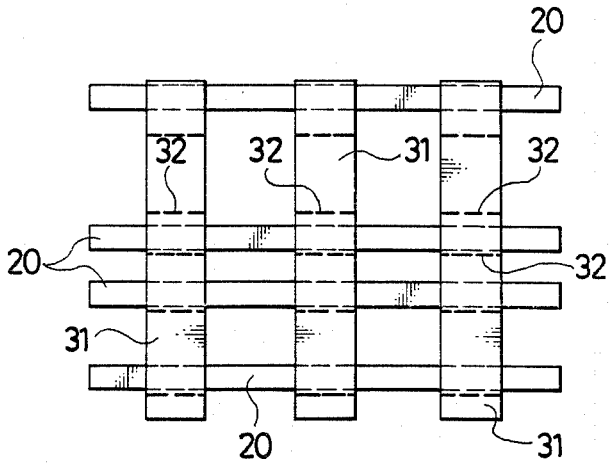
FIGS. 9 through 12 are explanatory views, respectively, illustrating the modified embodiments of the bulkhead device.

As shown in FIG. 2, the liner bag 5 is in the form of a tightly-closed rectangular box conforming the inner shape of the dry container 1 and comprises a bottom face 105, a pair of side faces 305, a front face 305, a door face 405 and an upper face 505. Both of the side edges of the upper face 505 are each formed into an arcuate shape curved inwardly with the longitudinal center thereof as the crest as shown in FIG. 9 and side belts 107 and 207, for example, made of polypropylene are secured respectively along both of the side edges.

Figure 3:
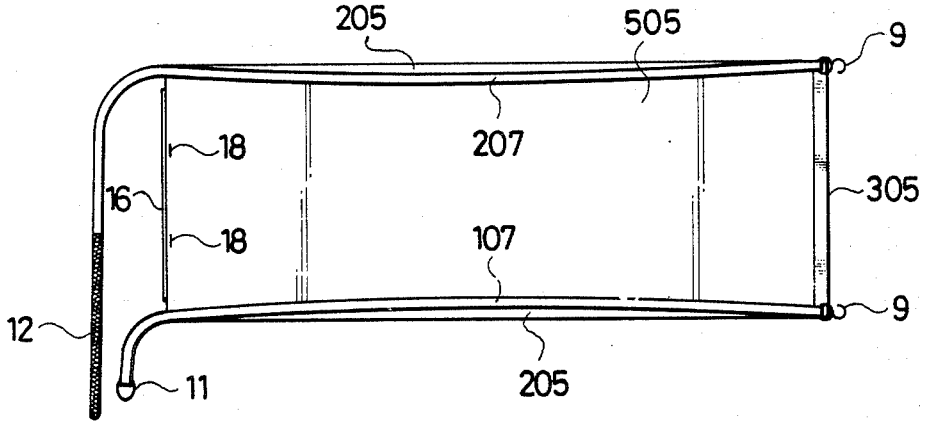
FIG. 3 is a plan view of the liner bag shown in FIG. 2.
Figure 4:
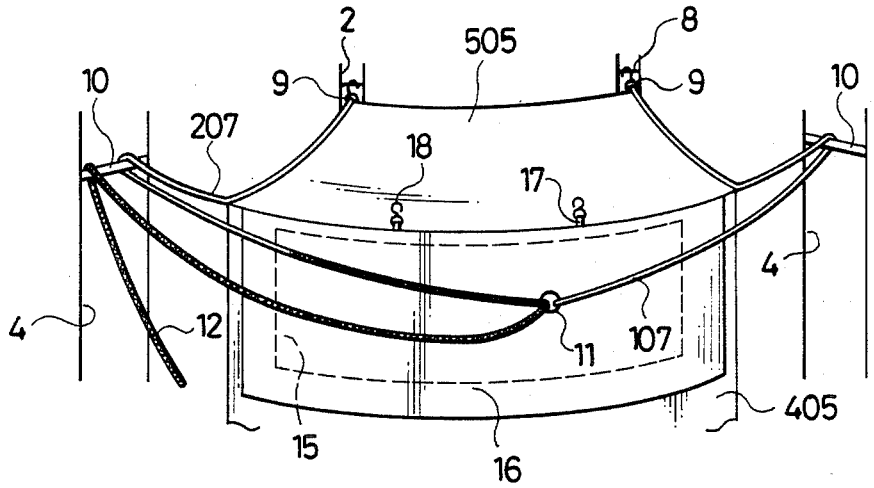
FIG. 4 is a perspective view of the liner bag when it is mounted to the container.

Upper end hooks 9 detachably engaged to engaging metals 8 secured to the inside of the square grooves 2 are attached to the end of the side belts 107 and 207 on the front side respectively as shown in FIGS. 2 through 4, while a buckle metal 11 and a cotton belt 12 that can be hooked to engaging metals 10 secured to the inside of the recessed grooves 4 and then clamped to the outer side of the door face 405 are disposed respectively to the end of the side belts 107 and 207 on the side of the door as shown in FIGS. 2 through 4.

Lower hooks 14 are attached near the lower ends of joining edges between each of the side faces 205 and the front face 305 by way of ring belts 13 respectively as shown in FIG. 2. Both of the lower end hooks 14 are detachably engaged to engaging metals (not illustrated) that are secured within the square grooves 2.

Further, a laterally extended rectangular charging port 15 is disposed at the upper portion of the door face 405 and the charging port 15 is closed from the outside by a closing cover 16 integrated at its upper edge to the upper edge of the door face 405 as shown FIGS. 2 and 4. Further, anti-sagging hooks 18 are attached by two to the upper edge of the door face 405 by way of the ring belts 17 as shown in FIGS. 2 and 3, and the anti-sagging hooks 18 are detachably engaged to the tightened side belts 107 and 207 on the door side as shown in FIG. 4.

Further, snap-buttons 19 are mounted, for example, by three to the lower edge of the charging port 15 and they are detachably snap-engaged to a bulkhead device 6 that supports the door face 405 at the position below the charging port 15 as shown in FIG. 2. A longitudinal flap may be disposed over the entire length of the lower edge of the charging port 15, instead of the snap-button piece 19, and the flap is laid over the upper end of the bulkhead device and then secured to the outer surface of the bulkhead device 6 by means of a string or the like.

Figure 5:
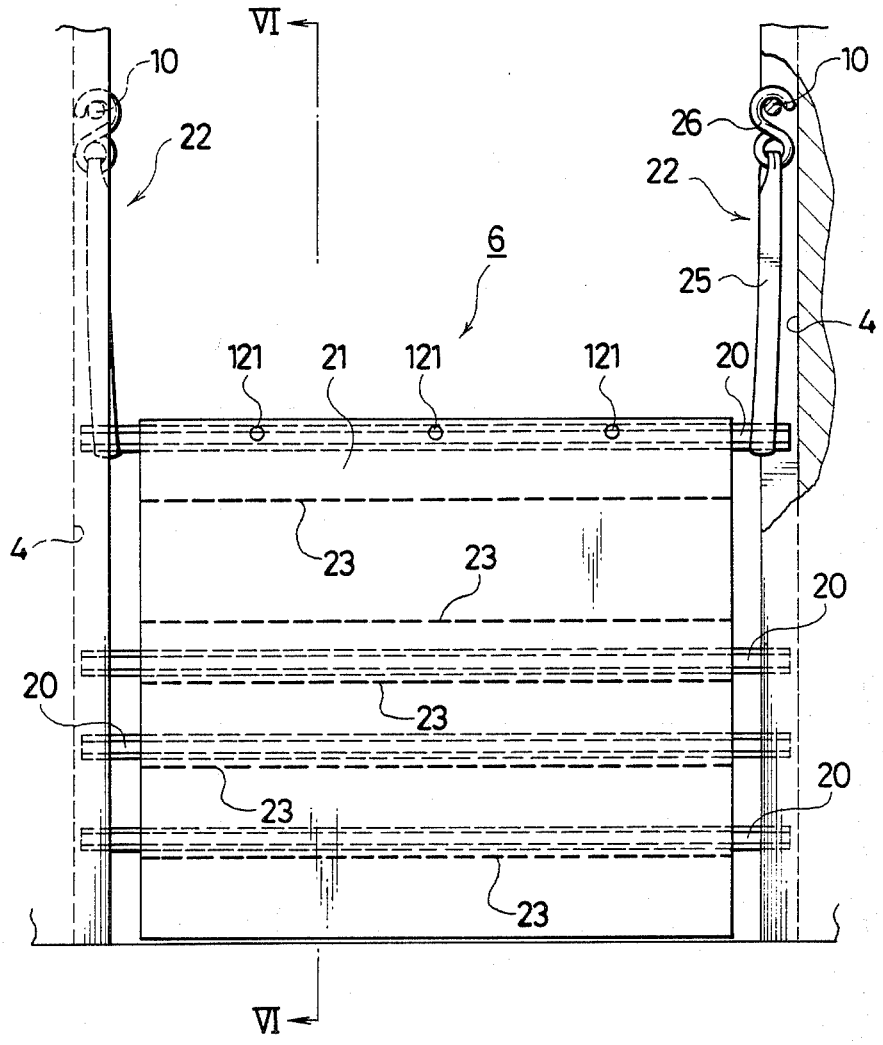
FIG. 5 is a detailed view of the bulkhead device observed from the door side.
Figure 6:
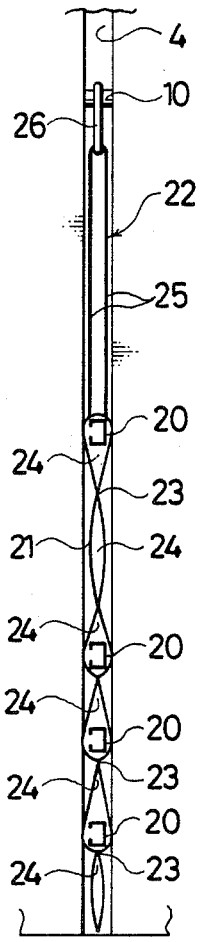
FIG. 6 is a cross sectional view taken along line VI—VI in FIG. 5.

As shown in FIGS. 5 and 6, the bulkhead device 6 comprises a plurality of support members 20 spaced apart vertically from each other and engaged detachably at their both ends to the recessed grooves 4, a sheet material 21 appended over the respective support members 20 and suspending belts 22 for positioning the uppermost support member 20.

Figure 7:
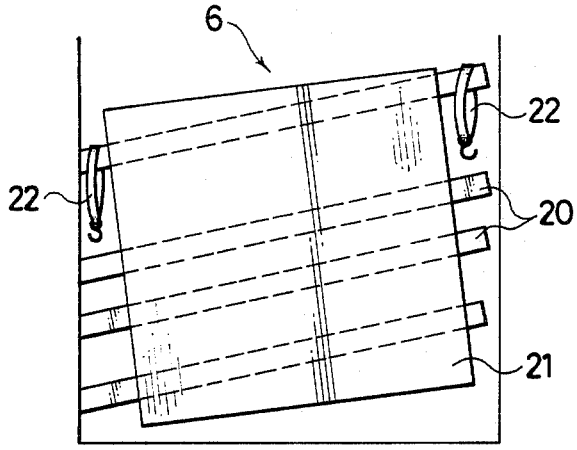
FIG. 7 is an explanatory view for the method of fitting to engage the support members into recessed grooves.

The support member 20 is formed with a C-shaped steel material of such a length that can be inserted to engage at its both ends into both of the recessed grooves 4 when arranged horizontally as shown in FIGS. 5 and 6. The support members 20 can be detached from the recessed grooves 4 by being tilted orthogonally in the longitudinal as shown in FIG. 7. Further, the sheet material 21 are made of tough and soft materials such as less stretcheable cloth, resin sheet or craft paper laminated with resin fabrics and are prepared by vertically folding a single sheet into a double-folded state and stitching this folded material at a plurality of stitching lines spaced apart vertically from each other, to form cylindrical portions 24 capable of detachably passing therethrough the support members 20 between each of the upper and lower stitching lines 23. By passing through each of the support members 20 into each of the cylindrical portion 24, the vertical position for each of the support members 20 is determined depending on the position of the cylindrical portion 24 through which the member is inserted. Specifically, the sheet material 21 serves both as a panel plate for supporting the force from the door face 405 and as a spacer for defining the vertical interval between each of the support members 20. As shown in FIG. 5, snap buttons 121 for the snap-engagement of the snap buttons 29 are disposed at the upper edge of the sheet material 21 as shown in FIG. 5.

Figure 8:
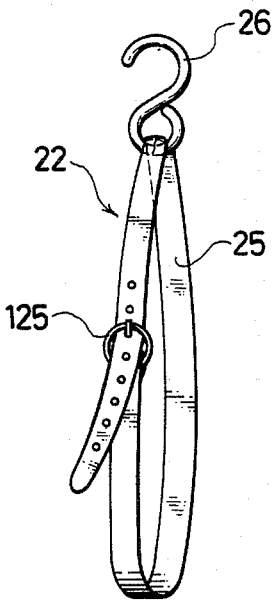
FIG. 8 is a detailed view for a suspending belt.

As shown in FIG. 8, the suspending belt 22 comprises a tough belt 25, for example, made of polypropylene and a hook 26 attached to the belt 25. The length of the belt 25 is adjustable by its buckle 125. As shown in FIG. 5, the suspending belts 22 are designed such that the vertical position of the uppermost support member 20 can be fixed by fitting to engage the uppermost support member 20 to the lower end of the belts 25 and detachably engaging the hooks 26 to the engaging metals 21 of the recessed groove 4 as shown in FIG. 5. That is, the suspending belts 22 function as a position apparatus for setting the vertical position of the uppermost support member 20.

The operation of the liner bag having such a bulkhead device will now be described.

Upon use, the liner bag 5 is at first conveyed into the dry container 1 and the hooks 9 and 14 at the upper and lower ends on the side of the door face 405 are engaged to the engaging metals 8 in the square grooves 2. Then, the ends of side belts 107 and 207 on the side of the door face 45 are engaged to the engaging metals 10 in the recessed grooves 4 and the end of the cotton belt 12 is once engaged to the buckle metal 11, engaged again to the engaging metal 10 and then pulled downwardly. Then, both of the side belts 107 and 207 are tightened and the liner bag 5 is mounted to the inside of the dry container with no sagging in the upper face 505.

When the operation for mounting the liner bag 5 has thus been completed, the bulkhead device 6 is mounted to the outer surface of the door face 405 of the liner bag 5, the snap-buttons 19 at the charging port 15 are snapped to the snap-buttons 121 on the sheet material 21, and the anti-sagging hooks 18 are engaged to the side belts 107 and 207.

Upon mounting the bulkhead device 6, the support members 20 are inserted through the cylindrical portions 24 of the sheet material 21 and then are fitted to engage at both their ends to the inside of the recessed grooves 4 while being tilted longitudinally as shown in FIG. 7. Then, the hooks 26 at the upper ends of the suspending belts 22 are engaged to the engaging metals 10 in the recessed grooves 4. Thus, the vertical position for the uppermost support member 20 is fixed by the suspending belts 22. Since the uppermost support member 20 and other support members 20 therebelow are vertically connected by way of the sheet material 21, the vertical position for the respective support members 20 are also determined relatively. Further, since the sheet material 21 is fixed at its upper end by the uppermost support member 20 and pulled at its lower portion downwardly by the own weight of the respective support members 20, the sheet material 21 can be set without sagging.

After the bulkhead device 6 has been thus mounted, granular goods are charged through the charging port 15 to the inside of the liner bag 5 by way of a screw conveyor or the like. In this case, although the door face 405 of the liner bag 5 is urged from the inside under the large load of the charged goods, since a plurality of support members 20 made of C-shaped steel material are disposed to the outer side of the door face 405, a sufficient withstanding force can be obtained. Further, since the space between each of the vertically adjacent support members 20 is closed by the tough sheet material 21, the door face 405 does not bulge in this portion even if the space between vertically adjacent support members 20 is somewhat large.

While on the other hand, upon discharging the goods from the liner bag 5, either one or both of the the doors 3 is opened, the lower portion of the sheet material 21 is cut out by using a knife or other cutting tool and the lower end portion of the door face 405 is also cut out through the cut portion formed to the sheet material. Then, goods in the liner bag 5 are discharged through both of the cut portions.

When the goods are discharged no more in the ordinary or substantially horizontal state, the dry container is tilted upwardly to attain a downward slope toward the doors 3. Then, the goods in the liner bag 5 are completely discharged. When the dry container 1 is tilted, an extremely large load is applied on the bulkhead device 6, but sufficient withstanding force can be obtained since the support members 20 are formed with C-shaped steel material as described above.

When the goods have thus been discharged completely, the bulkhead device 6 is detached at first and then the liner bag 5 is removed. Then, the bulkhead device 6 is re-used while replacing only the sheet material 21 with new one. In this case, a bulkhead device 6 suitable to the goods can be constituted by varying the position for inserting the support members 20 into the cylindrical portions 24 or by changing the number of support members 20 to be used. The bulkhead device 6, when it is not used, can be reduced in the size approximately equal to the total size of the support members 20.

Although explanations have been made in the foregoing embodiment to the case where the bulkhead device 6 is used for the liner bag 5 for use in the granular goods, it can similarly be applied also to the liner bag for use in hides or the likes. Since the goods of this kind are usually discharged from the container after detaching the bulkhead device, it is not necessary to cut through the sheet material 21. Accordingly, the sheet material 21 can also be reused in this case.

FIGS. 9 through 12 show modified embodiments of the bulkhead device 6 respectively and explanations will be made therefor.

In the embodiment shown in FIG. 9, a plurality (for example, three) of endless belts 31 each having stitching lines 32 are used instead of the sheet material 21 in the foregoing embodiment.

With such a constitution, the degree of freedom for each of the support members 20 is increased upon mounting the bulkhead device 6 to the recessed grooves 4 of the dry container 1, thereby facilitating the attaching and detaching operation.

Further, if the lower end of the door face 405 is cut by way of the gap between the adjacent endless belts 31 for discharging goods, it is not required to cut out the endless belts 31 and, accordingly, the belts can be reused. Further, in the case of re-using the bulkhead device 6 while replacing the endless belts 31 with new ones, the amount of the material 21 can be decreased as compared with that of the sheet material 21 in the foregoing embodiment and the material costs can be reduced.

Figure 10:
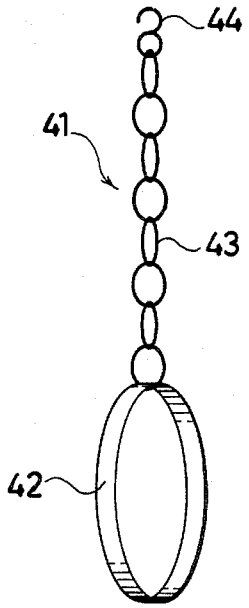

Further in the embodiment shown in FIG. 10, a suspending band 41 having an endless belt 42, a chain 43 and a hook 44 is used instead of the suspending belt 22 in the above embodiment and the length of the suspending band 41 is made adjustable by hooking the chain 43 to the engaging metal 10 in the recessed groove 4 and then adjusting the engaging position of the hook 44 to the chain 43.

The same effect as in the previous embodiment can also be expected by the use of the suspending band 41.

Figure 11:
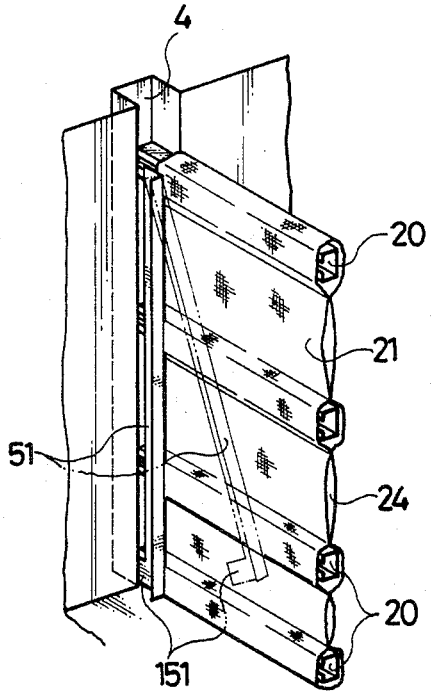

Further, in the embodiment shown in FIG. 11, two angled arms 51 (only one of them being illustrated in FIG. 11) pivoted at their both ends on the uppermost support member 20 are used instead of the suspending belt 22 in the foregoing embodiment. The angled arms 51 are made swingeable along the plane of the the sheet material 21 as shown by the solid line and the chained line in the figure and are disposed at each of their lower ends with a lower protrusion 151, which is fitted into the recessed groove 4 upon downwardly swinging the angled member 51 to stabilize the uprighted state of the angle member 51.

The similar effect to that of the suspending belt 22 can also be obtained by using the angled arm 51.

Figure 12:
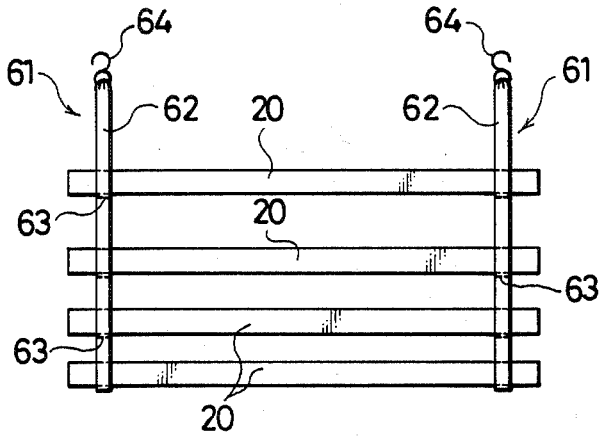

Furthermore, in the embodiment shown in FIG. 12, suspending bands 61 each comprising an endless belt 62 formed with stitching lines 63 at a plurality of positions and a hook 64 is used instead of the suspending belt 22 in the previous embodiment, so that all of the support members 20 are supported by the suspending band 61, thereby saving the use of the sheet material 21.

Since the sheet material 21 is no more necessary by the use of the suspending band 61 and the device can be manufactured at a reduced cost. The suspending band 61 is effective in the case where the vertical space between each of the support members 20 is narrow.

As has been described above, according to this invention, sufficient withstanding force can be obtained against the load exerted from the goods. Further, optimum withstanding force corresponding to the goods can easily be obtained by increasing or decreasing the number of support members corresponding to the types of goods. Moreover, since the support members are adapted to be fitted to engage into the recessed grooves already formed to both of the side walls of the container, there is no requirement for the reconstruction of the container. In addition, since each of the support members is spaced to a such an interval as predetermined by the spacer means, the withstanding force can be kept constant with no fluctuations irrespective of the operators' skills. Furthermore, the pattern of arranging the support members can be varied to obtain various distributions for the withstanding force, even for the identical number of the members, by adjusting the vertical space between each of the support members by means of the adjustment by the spacer means. Accordingly, the withstanding force can finely be controlled.

It will be apparent that various different embodiments can be constituted broadly without departing the spirit and the scope of this invention and, accordingly, this invention is no way restricted only to those specific embodiments and described and illustrated above unless defined by the appended claims.

What is claimed is:

1. A bulkhead device for use with container liner bags which are used to line the inside of a container of the type having a recessed groove defined therein comprising:

a plurality of support members extending in a substantially parallel spaced apart relation and having both ends thereof adapted to be disposed in the recessed grooves which are defined in side walls of the container so as to be detachable therefrom for supporting an end face of a liner bag on the side of a door of the container;

positioning means for fixing the vertical position of the uppermost of said support members; and spacer means for suspending the support members other than said uppermost support member from said uppermost support member thereby fixing the verticle position between said members.

2. A bulkhead device for use with container liner bags as defined in claim 1, wherein the spacer means comprises a sheet made of a substantially unstretchable sheet material having a lateral size slightly smaller than the length of the support members and cylindrical portions disposed at optional vertical intervals through which the support members are detachably inserted.

3. A bulkhead device for use in container liner bags as defined in claim 1, wherein the spacer means comprises a plurality of belt-like members disposed along the longitudinal direction of the support members while being spaced apart from each, each of said belt-like members being provided with a plurality of apertures at an optional vertical interval through which the support members are inserted.

4. A bulkhead device for use in container liner bags as defined in claim 3, wherein the support members are detachably inserted to the apertures of the belt-like members.

5. A bulkhead device for use in container liner bags as defined in any one of claims 1 to 4, wherein the positioning means comprises suspending belts detachable engaged by engaging means at their upper ends to the container for suspending the uppermost support member.

6. A bulkhead device for use in container liner bags as defined in claim 5, wherein each suspending belt has a plurality of support member inserting portions and serves also as the spacer means.

* * * * *